US005851351A

United States Patent [19]

Baecker et al.

[11] Patent Number: 5,851,351

[45] Date of Patent: Dec. 22, 1998

[54] METHOD OF MICROBIAL PRE-TREATING WOOD CHIPS FOR PAPER MAKING

[75] Inventors: Albin Alexander Wladyslaw Baecker, Westville; Graham David Shelver, Vorna Valley, both of South Africa

[73] Assignee: The Central Timber Co-Operative Ltd., Pietermaritzburg, South Africa

[21] Appl. No.: 703,669

[22] Filed: Aug. 27, 1996

[30] Foreign Application Priority Data

Aug. 29, 1995 [ZA] South Africa ..... 95/7243

[51] Int. Cl.[6] ..... D21H 25/02

[52] U.S. Cl. ..... 162/72; 162/DIG. 12; 435/278

[58] Field of Search ..... 162/DIG. 12, 22, 162/24; 435/277, 278

[56] References Cited

U.S. PATENT DOCUMENTS

| | | | |
|---|---|---|---|
| 4,687,745 | 8/1987 | Farrel | 162/72 |
| 5,476,789 | 12/1995 | Farrel et al. | 162/72 |
| 5,620,564 | 4/1997 | Akhtar | 162/72 |

OTHER PUBLICATIONS

Setliff et al, "Bimechanical pulping with white rot fungi"; TAPPI J. pp. 141–147, Aug. 1990.

Paice et al, "Direct Biological bleaching of hardwood kraft pulp with the fungus *Coriolus versicolor*", TAPPI J., pp. 217–221, May 1989.

*Primary Examiner*—Steven Alvo

*Attorney, Agent, or Firm*—Baker & Botts, L.L.P.

[57] ABSTRACT

A method of treating wood chips prior to making paper. In the process of making paper, wood chips must be converted to pulp through delignification of the wood and where white paper is required, bleaching to remove residual lignin also is required. The invention provides for the situation where wood chips are transported long distances by ship to paper mills, when the period of the journey is utilised to carry out pulping of the wood chips by biotechnological methods. Particularly, the conditions commonly existing in the hulls of the ships with which wood chips are transported are utilized to permit biopulping and/or biobleaching of the wood chips to occur. Suitable microorganisms, while in the form of viable propagules, are applied to the wood chips before or during loading into the hulls of ships, the microorganisms incubating and growing during the journeys, to permit biopulping and/or biobleaching to occur. In one embodiment the wood chips are inoculated with a slow-growing microorganism having hemicellulolytic capacity before being transported in a ship; and the wood chips are inoculated with a fast-growing microorganism having lignolytic capacity after being loaded into the hull of a ship.

13 Claims, No Drawings

METHOD OF MICROBIAL PRE-TREATING WOOD CHIPS FOR PAPER MAKING

This Invention relates to a method of treating wood chips prior to paper making.

It is know that wood chips comprise mainly amorphous lignin and fibrous cellulose bound together by hemicellulose. In the manufacture of sheets of paper from wood chips, the wood chips, prior to being converted to paper, are converted into a suitable pulp by mechanical comminution and/or chemical delignification. If the pulp is to be converted to white paper, remaining lignin residues must then be removed from it by subsequent bleaching. In particular, strong alkalis or acids are used to delignify the wood chips and produce a pulp residue comprising mainly cellulose fibers, the pulp residue then being chemically bleached to remove residual lignin before being converted to sheets of white paper.

Although the above pulping and biobleaching processes are relatively quick, energy costs for mechanical comminution and chemicals used are extremely expensive. Also, these processes produce large volumes of undesirable effluents which are creating a serious environmental problem in their disposal.

In order to alleviate the above problems, the use of microorganisms such as bacteria and/or ligninolytic fungi and/or microbial enzymes, herein merely referred to as microorganisms, have been considered for use in pulping and bleaching, these processes when using such microorganisms constituting microbial pre-treatment processes which include particularly processes herein referred to as "biopulping" and "biobleaching", respectively.

In addition to problems being experienced in identifying suitable microorganisms, it being required that the microorganisms used for true "biopulping" are preferably exclusively ligninolytic and/or hemicellulolytic and that they preferably do not affect cellulose fibres, it is also preferable that the individuals of any co-cultures grow and effect wood at the same rate. Another major problem associated with biopulping and biobleaching is that these processes are time consuming and require expensive bio-reactors. Even under optimal conditions, biopulping and/or biobleaching will take three to four weeks and this clearly is not acceptable to the industry insofar as the corresponding chemical processes require in the region of eight hours. The advantages associated with biopulping and biobleaching therefore have not justified the implementation of these processes and at best these processes have been used for pre-treatment before chemical treatment in a conventional way, thus at least resulting in savings in respect of chemicals and/or energy used.

Another form of fungal treatment of wood chips during storage prior to conventional pulping is referred to in the literature as a "biological aid to pulping", this form of treatment using fungi to "decrease tri-glycerides, fatty acids and resin acids". Although this form of treatment is designed to remove these from wood and subsequently reduce the unwanted incidence of sticky deposits on the paper machine, which is not a pulping or bleaching process, it is claimed that biopulping is a term to describe it because the fungus, while degrading the above non-lignocellulosic components of the wood, also bores holes through the wood fibres, which is said in turn to allow faster penetration of pulping chemicals during the pulping process, thus saving time. This form of treatment, however, can in no way be considered to constitute biopulping as herein envisaged and as explained hereinabove.

It is an object of this invention to render the microbial pre-treatment of wood chips which includes the biopulping and/or biobleaching processes acceptable to the industry and thereby to utilize the advantages associated therewith.

According to the invention there is provided a method of carrying out microbial pre-treatment of wood chips to be transported by ship, which comprises

- inoculating the wood chips with viable propagules of microorganisms having ligninolytic and hemicellulolytic capacity;
- loading the wood chips into the hull of a ship whereby the wood chips are to be transported and closing the hatches of the hull; and
- retaining the wood chips in the hull, while suitable conditions for incubation of the microorganisms exist, for a sufficient period to permit microbial pre-treatment to occur.

The wood chips may be inoculated with propagules of microorganisms constituting monocultures of different ligninolytic and hemicellulolytic fungi or, alternatively, may be inoculated with propagules of microorganisms constituting co-cultures of different ligninolytic and hemicellulolytic fungi.

The method of the invention may include inoculating the wood chips by spraying water incorporating the viable propagules of microorganisms onto logs from which the wood chips are formed, prior to their transportation. Alternatively, or in addition, the method may include inoculating the wood chips by incorporating the viable propagules of microorganisms into water sprayed onto the wood chips to reduce dust production during loading.

The method of the invention may include adding an incubation enhancing carbohydrate source and other incubation enhancing nutrients to the wood chips retained in the hull of a ship, it being envisaged that this carbohydrate source and nutrients be added to water sprayed onto the logs or chips as hereinabove envisaged.

Piling of wood chips and the loading of the wood chips into the hull of a ship may be conventionally carried out. Thereafter, when the hatches of the hull are closed and a ship cruises from one port to another, by the heat generated by the ship's engines and the sun and the subsequent metabolism of the microorganisms and the moisture contained in the wood chips in the hull, a dark, hot and humid environment is created in the hull which is particularly suitable for incubation of the microorganisms and resulting microbial pre-treatment to occur, i.e. biopulping and/or biobleaching of the wood chips.

It is envisaged that the wood chips will be retained in the hull of a ship for the duration of the journey of the ship to the required destination of the wood chips, microbial pre-treatment continuing for this duration. The microbial pre-treatment taking place during this period including biopulping and/or biobleaching either may provide for the resulting pulp to be immediately suitable for paper making, although if not complete, treatment will have occurred at least to the extent that the required pulping and bleaching of the wood chips will require a much reduced quantity of energy and/or chemicals, which in turn will result in a substantial cost savings, while the environmental problem associated with the use of chemicals also will be reduced.

It is known that wood chips are commonly transported by ships to remote paper mills and the method of the invention may thus apply particularly where wood chips are to be transported by ship from the source of chips to paper mills which will in any event require the wood chips to be contained in the hull of the ship for an extended period of time, e.g. three to four weeks or even longer. The time associated with biopulping and/or biobleaching clearly is not important in this situation insofar as the wood chips cannot during this time be subjected to conventional pulping and any pre-treatment occurring will effectively result in cost savings subsequently.

The method of the invention may include artificially enhancing and controlling conditions in the hull for microbial incubation and microbial pre-treatment to occur. Such control particularly may include aeration of wood chips contained in a ship's hull using a compressed air sparging system. Also, control may include measuring and controlling the temperature in a pile of wood chips in order to ensure effective incubation of microorganisms. The temperature may therefore be raised or lowered to maintain the cargo temperature at the optimal growth temperature of the microorganisms.

The invention thus extends particularly to the use of the invention in respect of wood chips which must be transported by a ship to a paper mill at a remote location.

Depending on microbial cultures identified and/or developed, provision can be made for both biopulping and biobleaching to occur. Separate microbial cultures ordinarily will provide for biopulping and/or biobleaching, although it is envisaged also that a single culture could provide for both biopulping and biobleaching. Similarly, separate cultures could be used together as co-cultures for hemicellulolysis and delignification although it is also envisaged that a single culture could provide for both without any cellulose degradation.

It is typically envisaged that the method of the invention includes inoculating the wood chips through viable propagules of microorganisms in the form of the ligninolytic and hemicellulolytic fungus *Phanerocheate chrysosporium.* Alternatively, the wood chips may be inoculated with viable propagules of microorganisms in the form of the hemicellulolytic fungus *Coriolus versicolor* and the ligninolytic fungus *Ceriporiopsis subvermispora.* Still alternatively, the wood chips may be inoculated with viable propagules of microorganisms in the form of the slow growing hemicellulolytic fungus *Schizophylium commune* and the fast growing ligninolytic fungus *Ceriporiopsis subvermispora.*

Further features of the invention, including the benefits associated with use of the invention, are described in more detail hereinafter, with reference to three examples of the invention, the first example involving the use of a fungal monoculture, the second example involving the use of a co-culture where each fungus grows at a similar rate, and the third example of the invention involving the use of a co-culture, but in which the hemicellulolytic fungus grows at a slower rate than the ligninolytic fungus.

The method of the invention, by way of each example, will be employed particularly where it is required to transport wood chips from the source of the chips to a paper mill located at a remote destination within the hull of a ship and where the wood chips therefore will be contained within the hull of a ship for an extended period of time, typically three to four weeks, or even longer. When wood chips are required to be so transported, prior to or during loading of the wood chips into the hull of a ship in a conventional manner, water containing viable propagules such as spores of biopulping and/or biobleaching fungi is sprayed onto the wood, the fungi including, for example, the ligninolytic hemicellulolytic fungus *Phanerocheate chrysosporium.* The water serves both to minimize dust production during loading of the wood chips into the hull of the ship and to inoculate the wood chips with the said spores of biopulping and/or biobleaching fungi. Before such spraying, the wood chips may be steamed in order to surface sterilize the wood chips before being inoculated with the desired organism. In addition to the fungal spores, a readily usable carbohydrate source and other nutrients in the form of trace elements that can stimulate incubation of the spores and subsequent fungal growth and ligninolytic and hemicellulolytic activities are incorporated into the water sprayed onto the wood chips, thus providing for the enhancement of fungal incubation and subsequent biopulping and/or biobleaching.

Following loading of the wood chips the hatches of the hull are closed down and the chips are then ordinarily transported to their destination. As a result of heat generated by the ship's engine and the sun and the metabolism of the fungus, a dark hot and humid environment will result within the hull, which is particularly suitable for incubation of the fungal propagules, thus resulting in fungal growth and ligninolytic activity providing for biopulping and/or biobleaching.

If contained in a ship's hull for a sufficient period of time, the wood chips could be converted into a pulp which will permit immediate paper making, although it is envisaged also that the method of the invention may provide only for biopulping or for biobleaching or merely for partial biopulping and/or biobleaching.

The method of the invention, by way of the second example, will be employed particularly where it is required to degrade the hemicellulose with one microorganism before delignifying it with a second one, when both microorganisms have similar growth rates. For this example, the hemicellulolytic microorganism is the fungus *Coriolus versicolor* and the ligninolytic fungus is *Ceriporiopsis subvermispora.* When wood chips require to be transported as above, prior to or during loading of the wood chips into the hull of a ship in a conventional manner, water containing spores or viable propagules of each fungus of the co-culture is sprayed onto the wood chips as described above for a monoculture, with the same overall conditions applying.

The method of the invention, in accordance with the third example, will be employed particularly where it is required to degrade the hemicellulose with one microorganism before delignifying it with a second one, when the hemicellulolytic microorganism has a much slower growth rate than the ligninolytic one. In this example the slow growing hemicellulolytic microorganism is the fungus *Schizophyllum commune* and the fast growing ligninolytic one is *Ceriporiopsis subvermispora.* When wood chips require to be transported as above, during chipping of the logs, water containing spores or viable propagules of *Schizophyllum commune* is sprayed onto the logs which are then converted to pre-inoculated chips which are piled for three or four weeks in a known manner. During this period the hemicellulolytic fungus degrades the hemicellulose in the chip pile as has been described above, and when the chips require to be transported, during loading of the wood chips in the conventional manner, they are sprayed with water containing spores or viable propagules of the fast growing fungus *Ceriporiopsis subvermispora* as described above, all the same conditions again applying.

It will be appreciated that the implementation of the method of the invention using biotechnology will not result in any time losses associated with the use of this technology insofar as pulping and bleaching is concerned and, as such, the benefits associated with biopulping and/or biobleaching are effectively utilized. Simultaneously, the disadvantages associated with chemical and/or mechanical pulping and bleaching will be at least reduced insofar as less chemicals and/or energy will be required in order to complete pulping and/or bleaching and the environmental problems associated with the disposal of the resulting effluents also will be reduced.

Although it is believed that the temperatures and humidities created within the hull of a ship will be suitable for the bioprocesses to occur, it is envisated that these conditions also could be artifically enhanced and/or controlled if required. Control may include temperature monitoring and aeration of wood chips which are contained in a pile in the hull of a ship and the killing by heat or fumigation or the like of viable microorganisms therein prior to or during unloading of the wood chips to prevent, if necessary, any allergic reactions in workers at their destination.

It is further envisaged that the use of the method of the invention will be closely linked with the identification and/or development of microorganisms suitable for biopulping and/or biobleaching, it being envisaged particularly that a single culture could be identified or developed that could result in a "one step" process that will render the use of the invention particularly attractive.

It will be appreciated that the use of the method of the invention will be particularly suitable for use by exporters of wood chips, insofar as they will render available to a paper mill at a remote destination not the wood chips, but a wood pulp that will require less treatment in order to be finally converted to paper. In effect, a higher value product is thus provided to the paper mill.

We claim:

1. A method of microbial pre-treatment of wood chips to be transported by a ship comprising:

chipping timber logs into wood chips and inoculating with viable propagules of a slow-growing microorganism having hemicellulolytic capacity wherein hemicellulose within the wood chips is degraded through incubation and growth of the microorganisms before transportation; and loading the wood chips into the hull of said ship and inoculating the wood chips with viable propagules a fast-growing of microorganism having ligninolytic capacity wherein the wood chips are delignified while contained within the hull of said ship within which suitable conditions for incubation and growth of the microorganisms having ligninolytic capacity are maintained during transportation.

2. A method as claimed in claim 1, which includes controlling the conditions in the hull for enhancing the microbial pre-treatment occurring.

3. A method as claimed in claim 2, which includes controlling the conditions in the hull by aerating the wood chips at predetermined intervals.

4. A method as claimed in claim 2, which includes controlling the conditions in the hull by setting the temperature in the hull at a level which will provide for optimal incubation and growth of the microorganisms.

5. A method as claimed in claim 1, in which the microbial pre-treatment provides for one of bio-pulping, bio-bleaching and a combination of bio-pulping and bio-bleaching to occur.

6. A method as claimed in claim 1 wherein inoculating the wood chips with viable propagules of microorganisms having hemicellulolytic capacity is performed by spraying water containing said propagules on the timber logs prior to chipping.

7. A method as claimed in claim 1 wherein inoculating the wood chips with viable propagules of microorganisms having hemicellulolytic capacity is performed by spraying water containing said propagules on the wood chips during or after chipping.

8. A method as claimed in claim 1 wherein inoculating the wood chips with viable propagules of microorganisms having ligninolytic capacity is performed by spraying water containing said propagules on the wood chips during or after loading.

9. A method as claimed in claim 1 further comprising adding an incubation-enhancing carbohydrate source and other incubation-enhancing nutrients to the wood chips, together with said viable propagules of microorganisms having hemicellulolytic capacity and said propagules of microorganisms having ligninolytic capacity.

10. A method as claimed in claim 1 wherein the viable propagules of microorganisms having hemicellulolytic capacity comprise a slow-growing hemicellulolytic fungus and the viable propagules of the microorganisms having ligninolytic capacity comprise a fast-growing ligninolytic fungus.

11. A method as claimed in claim 10 wherein the slow-growing hemicellulolytic fungus comprises *Schizophyllum commune* and the fast growing ligninolytic fungus comprises *Ceriporiopsis subvermispora*.

12. A method as claimed in claim 1 further comprising killing the viable microorganisms within the wood chips at the end of transportation.

13. A method as claimed in claim 12 wherein killing is performed by heating or fumigating said wood chips.

* * * * *